US005497510A

United States Patent [19]

Knowles et al.

[11] Patent Number: 5,497,510

[45] Date of Patent: Mar. 12, 1996

[54] THUMB PROTECTOR FOR FISHING AND METHOD OF GRIPPING SPORT FISH

[76] Inventors: Charles E. Knowles; Karen Knowles, both of 1014 Cabbott La., Richland, Miss. 39218

[21] Appl. No.: 205,561

[22] Filed: Mar. 4, 1994

[51] Int. Cl.[6] ..... A41D 19/00; A41D 13/10

[52] U.S. Cl. ..... 2/21; 2/161.5; 2/159; 43/4; 224/268

[58] Field of Search ..... 2/21, 159, 160, 2/161.1, 161.5, 161.6, 161.8, 163, 161.3, 16, 910, 917, 167; 224/103, 217, 218, 268; 43/4, 54.1, 55, 4.5, 42.06; 602/21, 22

[56] References Cited

U.S. PATENT DOCUMENTS

| | | | |
|---|---|---|---|
| 2,025,710 | 12/1935 | Beemer . | |
| 2,302,875 | 11/1942 | Lykins . | |
| 2,633,126 | 3/1953 | Newmark | 2/21 X |
| 2,782,422 | 2/1957 | Bencriscutto | 2/161.2 |
| 2,827,635 | 3/1958 | Rasmus | 2/21 |
| 3,547,112 | 12/1970 | Courtney | 2/159 X |
| 3,885,249 | 5/1975 | De Brabander | 2/917 X |
| 4,149,296 | 4/1979 | Stanford . | |
| 4,270,228 | 6/1981 | Gaiser | 2/917 X |
| 4,414,692 | 11/1983 | Dzierson et al. . | |
| 4,638,511 | 1/1987 | Haack . | |
| 4,665,565 | 5/1987 | Odom . | |
| 5,316,294 | 5/1994 | Turangan | 2/159 X |

FOREIGN PATENT DOCUMENTS

| | | | |
|---|---|---|---|
| 3203023 | 8/1983 | Germany | 2/160 |
| 547946 | 9/1942 | United Kingdom . | |
| 1013381 | 12/1965 | United Kingdom | 2/161.1 |
| 2143720 | 2/1985 | United Kingdom . | |
| 9008483 | 8/1990 | WIPO . | |

*Primary Examiner*—Paul C. Lewis
*Attorney, Agent, or Firm*—Richard C. Litman

[57] ABSTRACT

A hand protector for fishing has a thumb portion which includes material on at least the inner or pad side of the thumb, for the direct engagement of the teeth of a typical game or sport fish for the support and carriage thereof. The teeth engaging material may be any suitable pile type material comprising a multitude of small loops; the loop portion of hook and loop fastening material (e. g., Velcro, tm) may be used. The thumb portion of the protector also provides complete protection for the thumb of a wearer of the device, from possible injury from the teeth of the fish. In an alternative embodiment, the protector includes a glove covering most of the hand and providing for greater comfort in colder conditions. The four fingertips of the glove embodiment are open, to provide for good tactile feel for the user of the glove. The protector is positively secured to the hand of the user to preclude slippage when lifting or holding a fish by the thumb portion engaging the teeth of a fish, but the protector may be easily removed when desired.

8 Claims, 3 Drawing Sheets

THUMB PROTECTOR FOR FISHING AND METHOD OF GRIPPING SPORT FISH

FIELD OF THE INVENTION

The present invention relates generally to protective sports apparel, and more specifically to a hand or thumb protector for use in the handling of sport and game fish. The device serves to protect the hand of the wearer thereof, while simultaneously providing for the secure holding of a fish therefrom.

BACKGROUND OF THE INVENTION

Sport fishing has become an increasingly popular activity, and numerous devices have been developed to provide assistance in the luring, catching and handling of sport and game fish by sport fishermen. Generally, such articles have been devoted to the luring and catching of fish, with relatively little attention paid to the handling of the fish after capture. Nevertheless, some types of fish can still present hazards to a fisherman during the removal of hook(s) and the transfer of the fish from water to creel or other storage, etc.

Many, if not most, species of fish (e. g., the bass, which is an extremely popular game and food fish in the U.S.) which are sought by the typical angler, possess numerous relatively sharp teeth. Typically, a fisherman will have his/her hand in the mouth of the fish for the lifting of the fish from the water or other transport of the fish shortly after the catch, hook removal, etc.; the mouth of a fish provides a convenient means of handling the typical sport fish. However, the teeth of the fish render the hand of the fisherman quite vulnerable to at least minor injury, which may later become a major problem in the event of infection.

The need arises for a hand protector for use in fishing which not only protects at least a part of the hand of the wearer thereof from the teeth or other potential hazards of many fish, but which also provides a convenient means of lifting and transporting the fish by the mouth and teeth of the fish. Different embodiments must provide for differing amounts of cover for comfort in both warm and colder conditions and also provide for good tactile sense for the wearer thereof, as well as providing other features and benefits.

DESCRIPTION OF THE PRIOR ART

U.S. Pat. No. 2,025,710 issued to Idalyne M. Beemer on Dec. 31, 1935 discloses a Hand Covering resembling a glove in which the second, third and fourth fingers have been removed. Only the thumb and first or index finger are provided, and those two digits are completely closed, unlike the glove embodiment of the present invention. Moreover, no means is disclosed for the capture of sharp articles (e. g., the teeth of a fish) therein.

U.S. Pat. No. 2,302,875 issued to John Lykins on Nov. 24, 1942 discloses a Golfer's Glove having a channel diagonally disposed in the palm to provide for the gripping of a golf club grip. While the fingers of the glove are open at their distal ends, no thumb covering is provided, which renders the Lykins glove unsuitable for use in the environment of the present fishing hand protector.

U.S. Pat. No. 4,149,296 issued to Franklin D. Stanford on Apr. 17, 1979 discloses a Fish Holding, Scraping, And Cutting Glove. The entire hand, fingers, and thumb are completely enclosed, unlike the present invention, and the exterior surface of the glove includes a roughened palm with corrugations on the fingers for gripping, and with the fingertips including hardened edges for scaling a fish. A blade is also provided, extending through the pad of the thumb portion of the glove. The relatively thick palm and fingers required to provide the roughened gripping surfaces preclude any significant tactile feel through the glove, whereas the present fishing hand protector provides for such by means of the open fingertip areas in the glove embodiment and by the exposure of most of the hand in the thumb protector embodiment. The thumb cannot provide for any engagement with the relatively small and sharp teeth of a fish, or other sharp pointed articles, as does the present invention.

U.S. Pat. No. 4,414,692 issued to Mark A. Dzierson et al. on Nov. 15, 1983 discloses a Drinking Glove comprising a glove portion with truncated fingers and thumb, attachable to a cylindrical container holding portion. The lack of a thumb portion precludes use of the drinking glove in the environment of the present invention, and the means on the palm providing for attachment of the container holder would appear to reduce tactile sensitivity. In fact, the very purpose of the device is to reduce tactile sensitivity between a hot or cold container and the hand of the wearer of the glove. While the fingertips and thumb extremities are removed, the user's fingers and thumb contact only the exterior of the container holder secured thereto.

U.S. Pat. No. 4,638,511 issued to Peggy J. Haack on Jan. 27, 1987 discloses a Bowling Glove comprising a portion which secures around the wrist and across the web between thumb and forefinger area. The remainder of the glove is open, including the pad of the thumb. While tactile sensitivity is obviously provided by the open areas of the glove, no protection is provided on the pad of the thumb, rendering the device unusable in the environment of the present invention. Moreover, no means is provided for the passive capture of small, sharp articles therein, as with the present fishing glove.

U.S. Pat. No. 4,665,565 issued to Terrance J. Odom on May 19, 1987 discloses a Golf Glove having portions of hook and loop fastening material thereon. When the proper golf grip is assumed, the hook/loop material of one glove will engage the cooperating material of the other glove to provide a positive grip. Due to this need for a positive grip, the fingers and thumbs of both gloves are completely enclosed, unlike the present invention. Moreover, no means for passively engaging sharp points by the thumb(s) of the glove(s) are disclosed.

British Patent No. 547,946 to Roland G. Davies et al. and published on Sep. 18, 1942 discloses Improvements In Or Relating To Frictional Anti-Slipping Means. The apparatus comprises cooperating relatively high friction, abrasive material disposed upon the handle or grip of a tool or the like and on various surfaces of a glove. The fingers and thumb of the glove are completely enclosed either in glove or mitten form, unlike the present invention, and the abrasive material precludes engagement with sharp objects as provided by the present invention.

British Patent No. 2,143,720 to Andrew T. Moore and published on Feb. 20, 1985 discloses Gloves For Cleaning, Smoothing, And/Or Polishing Objects. In one embodiment, the abrasive is secured to the glove by cooperating hook and loop material (i.e., Velcro/tm), but the exposed abrasive surface fails to provide any means for passively gripping or engaging small pointed objects, such as the provision for engaging the teeth of a fish provided by the present invention. Moreover, the fingers and thumb are all completely enclosed, either in glove or mitten form.

Finally, PCT Patent No. WO 90/08483 to Linda M. Martin and published on Aug. 9, 1990 discloses Gloves For Mechanics comprising an inner glove which completely encloses the hand and an outer glove having truncated fingers and thumb. The palm portion of the outer glove may be covered with a relatively high friction material (e. g., roughened leather) to provide a better grip. While the outer and inner gloves may be worn separately in their separate embodiments, the tips of the fingers and thumb are all open for the outer glove, and are all completely enclosed for the inner glove; provision of a protected, completely enclosed thumb having material providing for the passive engagement of sharp pointed objects, in combination with at least open fingertips, as in the present invention, is not disclosed.

None of the above noted patents, taken either singly or in combination, are seen to disclose the specific arrangement of concepts disclosed by the present invention.

SUMMARY OF THE INVENTION

By the present invention, an improved hand protector for fishing is disclosed.

Accordingly, one of the objects of the present invention is to provide an improved hand protector for fishing which provides for the protection of the thumb of the wearer thereof from injury due to contact with the teeth of a fish or other sharp, pointed objects when grasping a fish by the mouth.

Another of the objects of the present invention is to provide an improved hand protector for fishing which provides means on at least the thumb portion for the direct engagement of the teeth of a fish, or other small, sharply pointed objects, therewith.

Yet another of the objects of the present invention is to provide an improved hand protector for fishing in which the tips of the four finger portions are removed in a glove embodiment to provide for sensitive tactile feel for the fingertips of a wearer of the glove embodiment.

Still another of the objects of the present invention is to provide an improved hand protector for fishing which includes means providing for the positive security of the protector on the hand of the user, which security means is easily securable and openable to provide for the removal of the protector from the hand when desired.

A further object of the present invention is to provide an improved hand protector for fishing which may be cleaned easily as required.

A final object of the present invention is to provide an improved hand protector for fishing for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
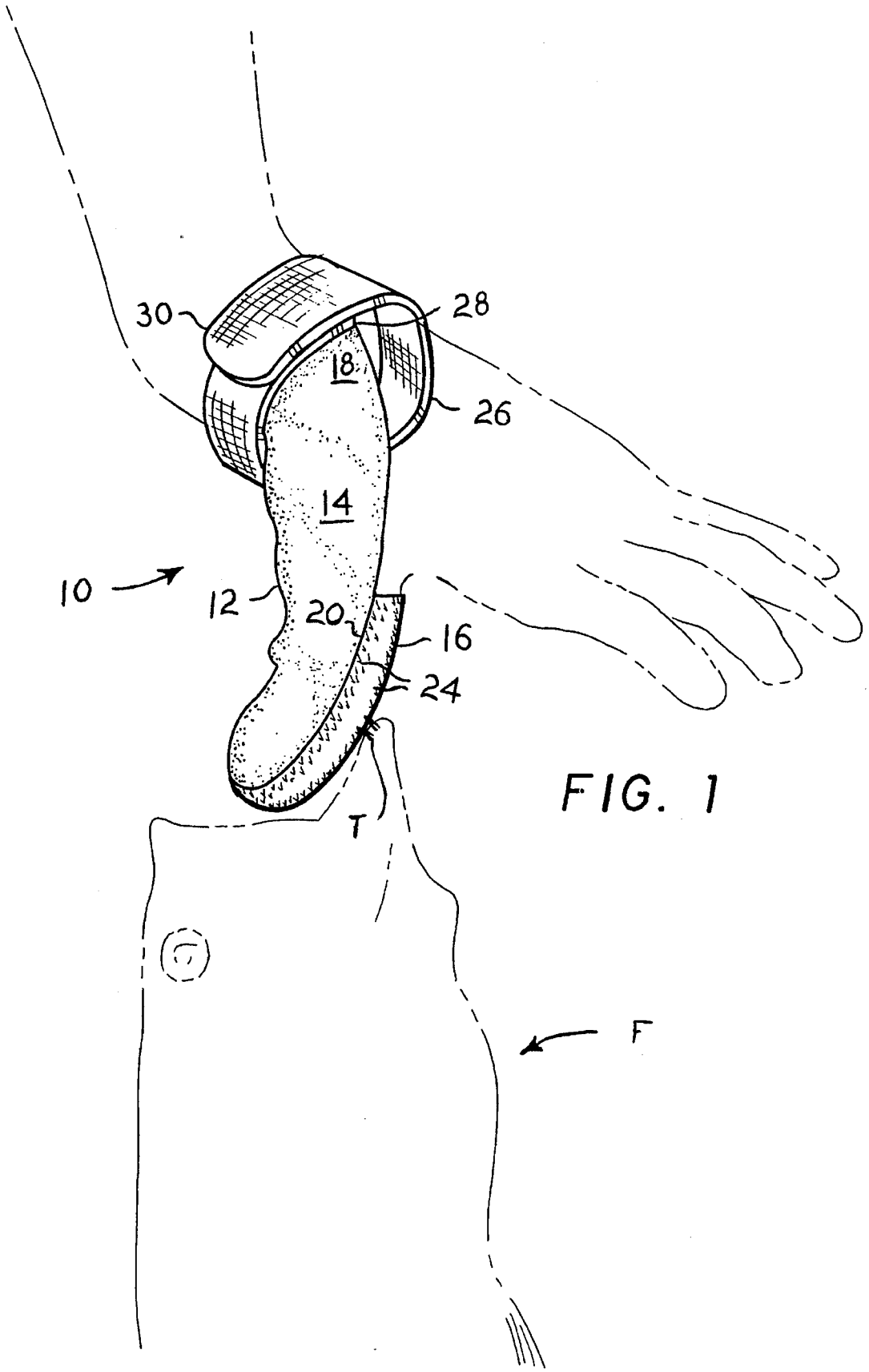
FIG. 1 is a perspective view of one embodiment of the hand protector of the present invention, showing its use in supporting a fish and protecting the thumb of the wearer.

Referring now particularly to FIG. 1 of the drawings, the present invention will be seen to relate to a hand protector 10 for use in fishing, to protect the hand (or portion thereof) of the angler from the sharp, needle like teeth T of a fish F. Generally after a catch is made, the fish is lifted from the water, net, etc. by inserting one thumb into the mouth of the fish and grasping one gill cover with the fingers. As many sport and game fish have relatively sharp teeth, the thumb may be injured during such an operation. While most fresh water sport fish likely to be handled in such a manner possess relatively small teeth and are unlikely to do significant damage to the hand of the fisherman, nevertheless a wound incurred by such means is almost certain to be unsanitary and prone to infection.

The present hand protector 10 simultaneously provides two advantages in the handling of such a fish F, by (1) protecting the hand or thumb of the fisherman from injury due to the teeth T of the fish F, and (2) providing a material on the surface of the protector which serves to catch and engage the teeth T of the fish F in order to provide a more positive grip of the fish for the fisherman. The hand protector embodiment 10 of FIGS. 1 and 2 includes a thumb enclosure portion 12 formed of a back surface 14 and an opposite front surface 16. The back surface 14 extends from the tip of the thumb, over the back of the thumb and across the knuckles, to terminate at a wrist attachment end 18 at the wrist of the wearer thereof. The front surface 16 extends from the tip of the thumb, over the pad of the thumb to terminate at approximately the second joint of the thumb, or approximately one half the length of the back surface 14. The back surface 14 and front surface 16 are joined along their common edge 20 to form a protective pocket 22 (FIG. 2) for the thumb of the fisherman wearing the hand protector 10.

Preferably, the back surface 14 is formed of a relatively flexible and elastic fabric material (e. g., spandex) in order to provide the needed flexibility and stretch over the joints or knuckles of the thumb. However, the front surface 16, which provides for the engagement of the teeth T of the fish F, is of necessity a different material. It has been found that the loop portion 24 of cooperating hook and loop fastener material (e. g., Velcro/tm) provides excellent results as a material for the front surface 16 of the hand protector 10. The loops 24 provide an excellent engaging means for the relatively small and sharp teeth T of a typical sport fish F, while the standard relatively stiff and heavy backing of the loop material 24 serves well to prevent penetration of the fish teeth T therethrough to protect the thumb of the wearer of the present invention. Alternatively, other materials may be used in lieu of the loop portion of hook and loop fastening material, e. g., wool, some knit fabrics, etc. The specific material may be varied, so long as the material possesses some looped pile characteristics enabling the relatively small, sharp teeth T of a fish F to directly engage the pile or loops and be captured thereby.

The wrist attachment end 18 of the back surface 14 includes a wrist attachment strap 26 extending transversely thereacross, with the wrist strap 26 having cooperating first and second ends 28 and 30. The cooperating first and second ends are securable together, e. g., by means of cooperating hook and loop fastening material 24*a* and 24*b* (FIG. 2), to secure the hand protector 10 to the hand and wrist of the wearer thereof; other fastening means (snaps, buttons, etc.) may be used as desired. Preferably, the wrist attachment strap 26 is formed of a flexible elastic fabric material, although alternatively a relatively non-elastic material (fabric, plastic, leather) may be used as desired.

The above described protector 10 is particularly suitable for use in warmer weather or water. FIG. 3 discloses an alternative embodiment providing greater comfort for the user thereof in colder conditions. The hand protector 10*a* of FIG. 3 will be seen to include most of the equivalent features of the hand protector 10 of FIGS. 1 and 2, i. e., a thumb enclosure portion 12*a* formed of a back surface 14*a* and an opposite front surface 16*a*. As in the case of the hand protector 10 of FIGS. 1 and 2, the back portion 14*a* extends from the thumb tip to a wrist attachment end 18*a*. The front portion 16*a* extends from the thumb tip to approximately the second joint of the thumb, where it joins the remainder of the hand protector 10*a*. The back and front surfaces 14*a* and 16*a* are joined along their common edges 20*a*, as with the hand protector 10 of FIGS. 1 and 2, to form a protective pocket or thumb enclosure therein.

Figure 2:
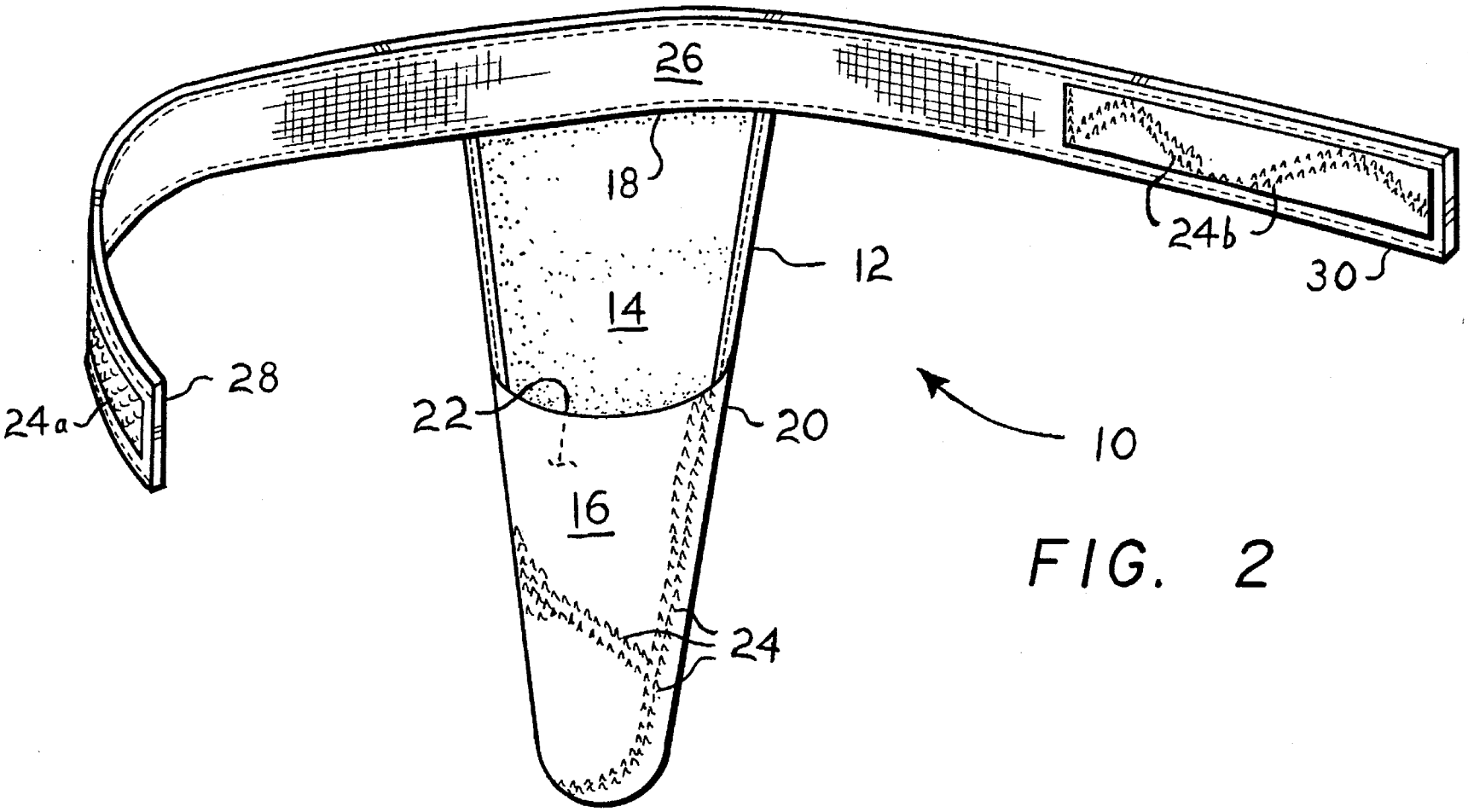
FIG. 2 is a perspective view of the thumb protector embodiment of FIG. 1, showing the details of the thumb portion and the means providing for securing the protector to the hand.
Figure 3:
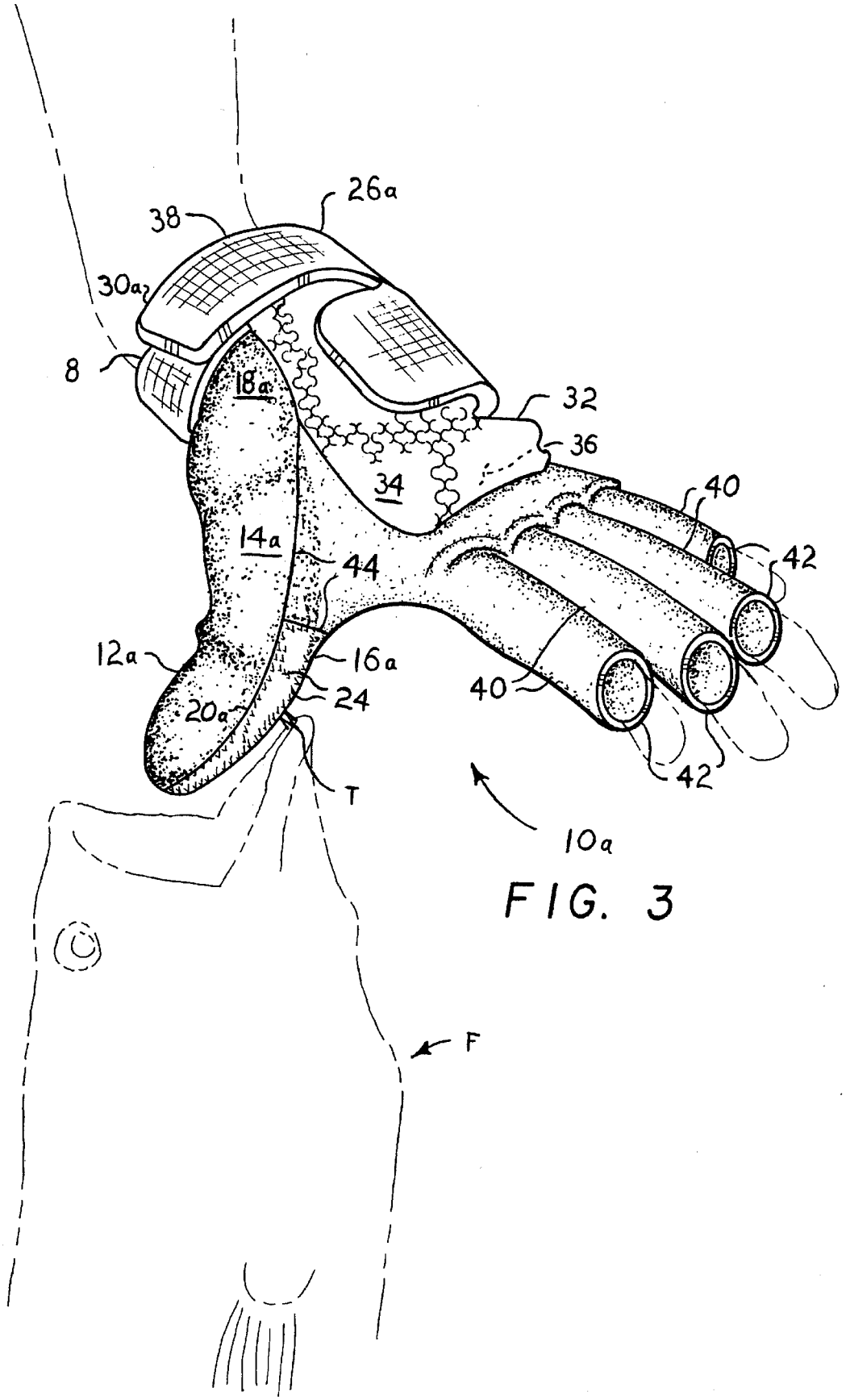
FIG. 3 is a perspective view of a second embodiment of the present invention, having greater hand protection for use in colder weather or conditions.

As in the case of the hand protector 10 of FIGS. 1 and 2, the back surface 14*a* of hand protector 10*a* is formed of a relatively flexible and elastic fabric material in order to provide the needed flexibility and stretch over the joints or knuckles of the thumb. The front surface 16*a*, which provides for the engagement of the teeth T of the fish F, is preferably formed of the loop portion 24 of cooperating hook and loop fastener material, to provide the same dual advantages of hand protection and engagement with the teeth T of the fish F as provided by the hand protector 10 of FIGS. 1 and 2. Again, other materials may be used in lieu of the loop portion of hook and loop fastening material, e. g., wool, some knit fabrics, etc.

Unlike the embodiment of FIGS. 1 and 2, the hand protector 10*a* of FIG. 3 includes further hand protection in the form of a hand enclosure portion 32 having a back surface 34, a front surface 36, and a wrist opening 38. Four finger enclosure portions 40 extend from the hand enclosure portion 32, each comprising a substantially tubular extension. Each of the finger enclosures 40 may have an open end 42, if desired, in order to provide the desired tactile sensitivity and feel for the wearer of the hand protector 10. The thumb enclosure portion 12*a* is attached to the hand enclosure portion 32 along seams 44, to provide substantially greater protection for the hand of the wearer.

The wrist opening 38 of the hand protector 10*a* includes a wrist attachment strap 26*a* extending transversely thereacross, with the wrist strap 26*a* having cooperating first and second ends 28*a* and 30*a*, as in the manner of the hand protector 10 of FIGS. 1 and 2. The cooperating first and second ends 28*a* and 30*a* are securable together as in the hand protector 10 of FIGS. 1 and 2, to secure the hand protector 10*a* to the hand and wrist of the wearer thereof; various alternative fastening means (snaps, buttons, etc.) may be used as desired. The wrist attachment strap 26*a* may be formed of a flexible elastic fabric material, as in the hand protector 10 of FIGS. 1 and 2, although a relatively non-elastic material (fabric, plastic, leather) may be used as desired.

Accordingly, the embodiments of the present invention will be seen to provide hand protectors capable of simultaneously performing the dual function of protecting the hand or thumb of a fisherman particularly from the teeth of a fish while handling the fish, and further to provide a positive means of lifting the fish by engaging the teeth of the fish with a cooperating capture surface of the hand protector. The hand protector may comprise essentially an attachable covering for the thumb of the wearer, thus leaving the balance of the hand exposed; this embodiment is particularly useful in warmer weather or water, and is also valuable in that it is equally adaptable to either the left or right hand. Alternatively, an embodiment providing greater hand coverage is provided for use in colder conditions, as desired. While the embodiment of FIG. 3 as shown is not readily transferable from one hand to the opposite hand, it will be seen that a mirror image hand protector may be easily constructed to provide for use on and protection of either the left or right hand.

It is to be understood that the present invention is not limited to the sole embodiments described above, but encompasses any and all embodiments within the scope of the following claims.

I claim:

1. A thumb protector for fishing, providing for the support and carriage of a fish by teeth of the fish and further providing protection from injury from the fish teeth for a thumb of a wearer of said thumb protector, said thumb protector consisting essentially of:

a thumb enclosure portion including a back surface completely covering the back of a thumb of the wearer thereof and extending from the tip of the thumb to a wrist attachment end terminating at a wrist of a wearer thereof, and a front surface covering the pad of the thumb and extending from the tip of the thumb over the first two joints of the thumb, with said back surface and said front surface having joined common edges to form a protective pocket therebetween for the thumb of the wearer thereof, and;

said back surface of said thumb enclosure portion being formed of a flexible material providing freedom of movement for the thumb of the wearer of said thumb enclosure portion, and said front surface being formed of a material resistant to penetration by the teeth of a fish and further including means providing for direct engagement of the teeth of a fish therewith, whereby;

said thumb protector is placed upon the thumb of a wearer thereof with the thumb of the wearer inserted into said protective pocket of said thumb enclosure portion, and said thumb enclosure portion of said thumb protector is inserted into the mouth of the fish and said direct engagement means on said thumb enclosure portion directly engages the teeth of the fish to support a fish directly by said thumb enclosure portion, and said penetration resistant material of said front surface of said thumb enclosure portion precludes the penetration of said front surface by the teeth of the fish, thereby protecting the thumb of a wearer of said thumb protector from injury by the teeth of the fish.

2. The thumb protector of claim 1 wherein:

said means providing for the direct engagement of the teeth of a fish therewith on said front surface of said thumb enclosure portion comprises a pile material comprising a multitude of textile loops.

3. The thumb protector of claim 2 wherein:

said pile material comprises the loop portion of complementary hook and loop fastening material.

4. The thumb protector of claim 1 wherein:

said back surface of said thumb enclosure portion is formed of a flexible elastic fabric material.

5. The thumb protector of claim 1 wherein:

said back surface of said thumb enclosure portion includes a wrist attachment strap extending across said wrist attachment end, with said wrist attachment strap including opposite first and second ends with said first and second ends of said wrist attachment strap including cooperating means providing for the securing of said first end of said strap to said second end of said strap.

6. The thumb protector of claim 5 wherein:

said wrist attachment strap is elastic.

7. The thumb protector of claim 5 wherein:

said cooperating means providing for the securing of said first end of said strap to said second end of said strap comprises cooperating hook and loop fastening material.

8. A method of gripping sport fish, comprising the steps of:

enclosing a hand in a hand protector having a hand enclosure portion including a back surface, a front surface, and a wrist opening, four finger enclosure portions extending from the hand enclosure portion, each finger enclosure portion comprising a substantially tubular extension, and a thumb enclosure portion extending from the hand enclosure portion and including a back surface completely covering the back of the thumb of a wearer thereof and extending from the tip of the thumb to a wrist attachment end terminating at the wrist opening of the hand enclosure portion, and a front surface covering the pad of the thumb and extending from the tip of the thumb over the first two joints of the thumb, with the back surface and the front surface having joined common edges to form a protective pocket therebetween for the thumb of the wearer thereof, the back surface of the thumb enclosure portion being formed of a flexible material providing freedom of movement for the thumb of the wearer of the thumb enclosure, and the front surface being formed of a material resistant to penetration by the teeth of a fish and further including means providing for the direct engagement of the teeth of a fish therewith, the means providing for direct engagement being a pile material having a multitude of textile loops;

inserting the thumb enclosure portion of the hand protector into the mouth of the fish;

directly engaging teeth of fish with the direct engagement means on the front surface of the thumb enclosure portion;

supporting a fish directly by the thumb enclosure portion of the hand protector, the penetration resistant material of the thumb enclosure portion of said hand protector thereby precluding the penetration of the front surface of said thumb enclosure portion of the hand protector by the teeth of the fish, thereby protecting the hand of a wearer of said hand protector from injury by the teeth of the fish.

* * * * *